US008201513B2

(12) United States Patent
Hansen et al.

(10) Patent No.: US 8,201,513 B2
(45) Date of Patent: Jun. 19, 2012

(54) VENTILATED STEP BOAT HULL WITH TUNNEL AND MOVABLE MEMBER POSITIONED THEREIN

(76) Inventors: Lloyd T. Hansen, University Place, WA (US); John F. Hansen, Tumwater, WA (US)

( * ) Notice: Subject to any disclaimer, the term of this patent is extended or adjusted under 35 U.S.C. 154(b) by 175 days.

(21) Appl. No.: 12/431,066

(22) Filed: Apr. 28, 2009

(65) Prior Publication Data

US 2010/0269747 A1 Oct. 28, 2010

(51) Int. Cl.
*B63B 1/22* (2006.01)

(52) U.S. Cl. ..... 114/284; 114/291; 114/288

(58) Field of Classification Search ..... 114/140, 114/280, 284, 288, 291, 285, 121, 125
See application file for complete search history.

(56) References Cited

U.S. PATENT DOCUMENTS

| | | | | |
|---|---|---|---|---|
| 3,602,178 | A * | 8/1971 | White | 114/285 |
| 4,599,964 | A * | 7/1986 | Kenney et al. | 114/124 |
| 4,649,851 | A * | 3/1987 | April | 114/271 |
| 2006/0272567 | A1 * | 12/2006 | Scotti | 114/362 |
| 2007/0028827 | A1 * | 2/2007 | Smith | 114/285 |

* cited by examiner

*Primary Examiner* — Stephen Avila
(74) *Attorney, Agent, or Firm* — Clark A. Puntigam; Jensen & Puntigam, P.S.

(57) ABSTRACT

The boat hull has an exterior lower surface with at least one step surface therein. A channel extends from the step surface to the bow of the boat, with an opening at the bow, permitting air to flow along the channel. A movable member is positionable within the channel, wherein the movable member and can be positioned at selected locations therealong, defining an adjustable additional step for the hull.

18 Claims, 10 Drawing Sheets

VENTILATED STEP BOAT HULL WITH TUNNEL AND MOVABLE MEMBER POSITIONED THEREIN

TECHNICAL FIELD

This invention relates generally to boat hull construction, and more specifically concerns a boat hull with an adjustable planing surface. The boat hull may, but not necessarily, include one or more steps in the hull.

BACKGROUND OF THE INVENTION

First, with respect to stepped hull boats, such hull configurations are well known. Stepped hulls are used in general to reduce drag. One example of a stepped hull is shown in U.S. Pat. No. 4,027,613. Other stepped hull designs are shown in U.S. Pat. Nos. 6,415,731 and 6,925,983. A stepped hull is advantageous, including as indicated above, the reduction of drag, with resulting increased hull efficiency relative to a similar hull which is non-stepped. Stepped designs have been used in various general hull configurations, including deep-V mono-hull configurations, hydroplane-type hulls and tunneled hulls. Conventional stepped hull configurations, however, are fixed, i.e. the position and configuration of the step or steps cannot be altered after the hull is constructed. The effectiveness of stepped hull configurations varies. One stepped hull configuration may be advantageous in one type of sea condition to produce a better ride, while in other sea conditions a different stepped hull configuration might be preferred. Various trimming techniques can be used to modify or change the effect of a stepped hull configuration to produce a particular effect, including improvement in handling and/or performance, although trim tabs can create drag.

With regard to performance in particular, it is desirable in some cases to change the running of the boat, including changing the position of the bow and stern of the boat during operation, to obtained desired speed and/or other performance considerations, as well as maintaining a desired ride. Such adjustments can be conventionally achieved by adjusting engine trim, which may not be possible in those cases where the engine is fixed. In addition, the type of propeller can also be changed to change performance and/or ride characteristics. This will often, however, be inconvenient and still may not produce the desired result. As indicated above, trim tabs are useful but can produce drag.

It is hence desirable to provide a type of hull configuration, including stepped hulls, in which the hull and/or the steps in the hull can be conveniently adjusted to accommodate different sea conditions, as well as provide different performance characteristics. It is also desirable to have a hull arrangement by which the bow or the stern can be raised or lowered.

SUMMARY OF THE INVENTION

Accordingly, the boat hull comprises: a boat hull having an exterior surface; a support system extending along the hull surface a selected distance from a start point toward the bow of the boat; and a member positionable in the support system, wherein the member is movable along the support system and can be fixed at selected locations therealong, thereby changing the position of a stern end of the movable member and hence the position of a step surface in the hull surface.

BEST MODE FOR CARRYING OUT THE INVENTION

The figures show various embodiments of a stepped hull boat configuration which incorporates at least one longitudinal channel in the boat hull, terminating at a step surface located at a selected point along the hull. While the figures show stepped hull boats, it should be understood that a stepped hull is not necessary. The channel can extend to the very front (bow) of the boat or can be vented to the sides of the boat, and be open to atmosphere, thereby providing a vented arrangement, in which air flows through the channel from the bow or sides of the boat to the step surface. In a non-vented arrangement, the channel extends only part way to the bow of the boat from the step surface and is not open to the atmosphere. Positioned in the channel is a movable member, also referred to as a shoe, which is movable longitudinally within the channel to provide an adjustable step surface longitudinally of the boat hull. The movable member could also be supported by elements adjacent the hull instead of within a channel in the hull.

Figure 1:
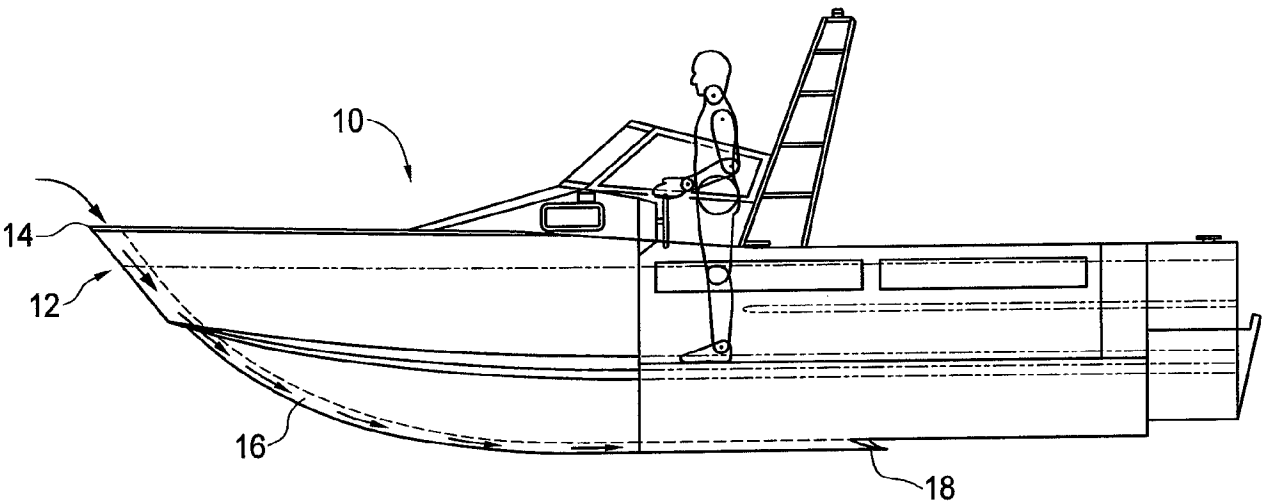
FIGS. 1 and 2 are side elevational and top views of a boat incorporating a vented channel with a movable member therein.
Figure 2:
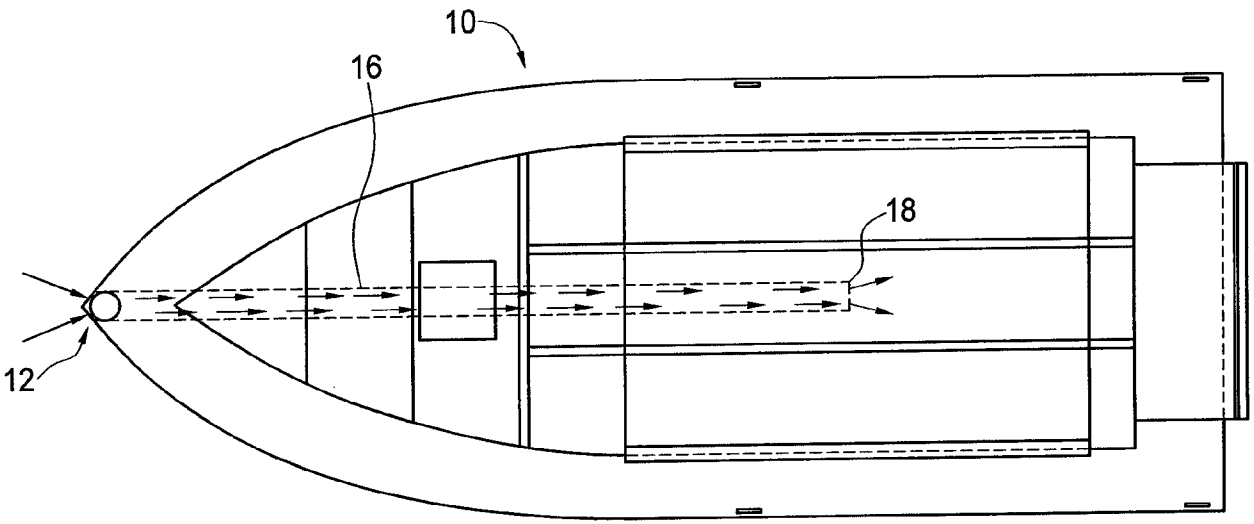

The arrangement in FIGS. 1 and 2 is for a vented channel in a mono-hull boat, shown generally at 10. Extending from bow 12 of the boat, typically at a topmost point 14, is a channel 16 which extends longitudinally of the hull from bow 12 to a step surface 18, which is located at a selected point along the hull, typically but not necessarily beyond a longitudinal mid-point of the hull toward the stern. Air is free to move along the channel from the bow 12 and out from step surface 18.

Figure 3:
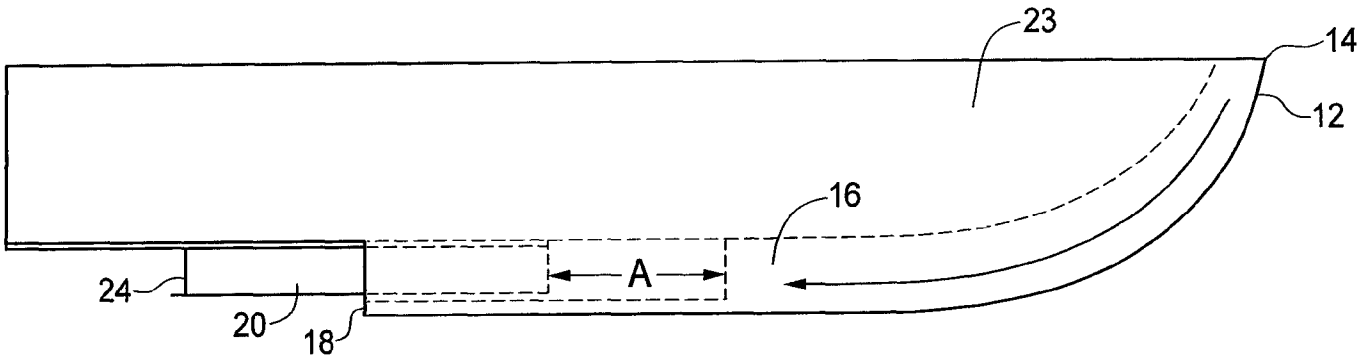
FIG. 3 is a longitudinal cross-sectional view of the new hull arrangement of FIGS. 1 and 2.
Figure 4:
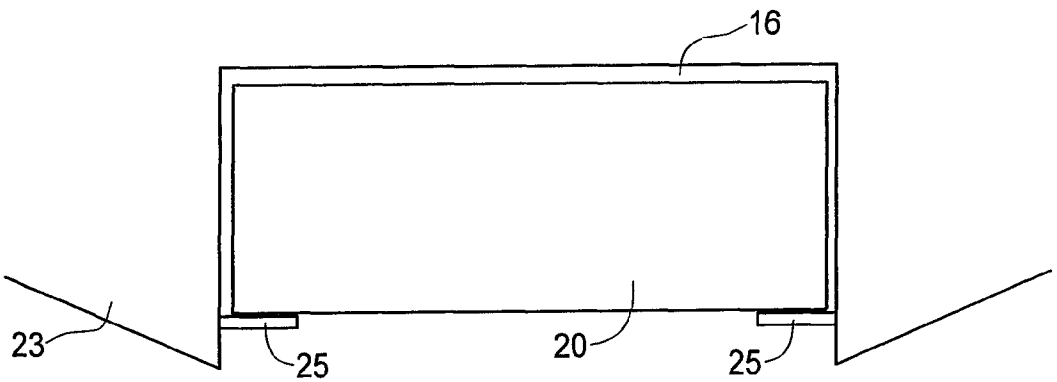
FIG. 4 is a lateral cross-sectional view of another movable member embodiment in a boat hull.

Channel 16 can be of various widths and depths, extending for the full width of the step surface 18 or a portion thereof. Referring now to FIGS. 3 and 4, as well as FIGS. 1 and 2, a movable member 20, also referred to as a shoe, is positioned within channel 16. In FIGS. 3 and 4, the movable member is configured so that the channel is vented, i.e. there is room in channel 16, which extends from the front (bow) of the boat, for air to move through channel 16, around member 20, and out the channel opening in the step surface 18. FIG. 3 shows the movable member 20 in an extended position, with distal end 24 defining in effect a movable (adjustable) second step for the hull 23, in addition to the fixed hull step surface 18. The movable member 20 in FIG. 3 can move through a range shown as A in FIG. 3. The position of the movable member can vary, as determined by desired performance and/or handling criteria. Various performance and handling criteria can be accommodated with a single structure with this arrangement. Alternatively, the movable member 20 can itself be hollow, such that air moving through channel 16 could also move through the movable member, to vent the rear of the movable member. Movable member 20 can be held in place after being positioned by various elements, including various attaching members, such as screws or other retaining elements, or can be supported along the length thereof by flanges 25 in the channel.

Figure 5:
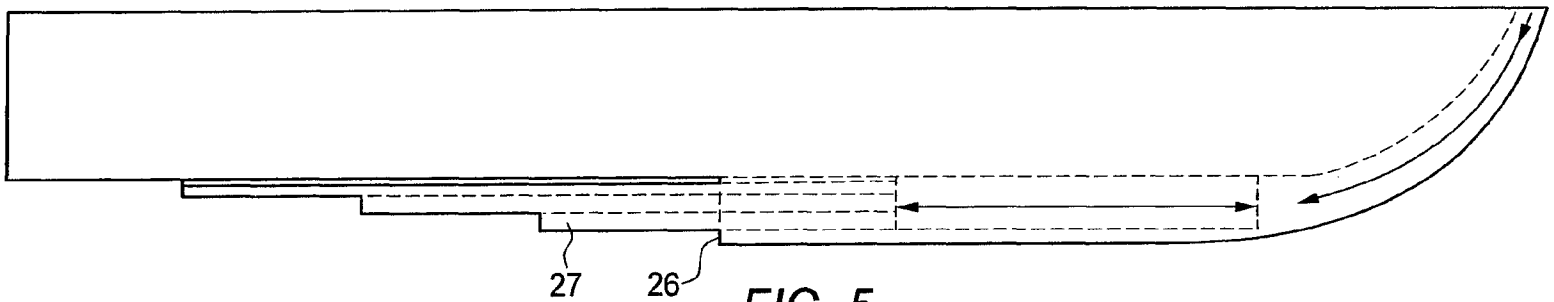
FIG. 5 is an elevational view of another movable member embodiment in which the movable member itself has a plurality of steps in its lower surface.
Figure 6:
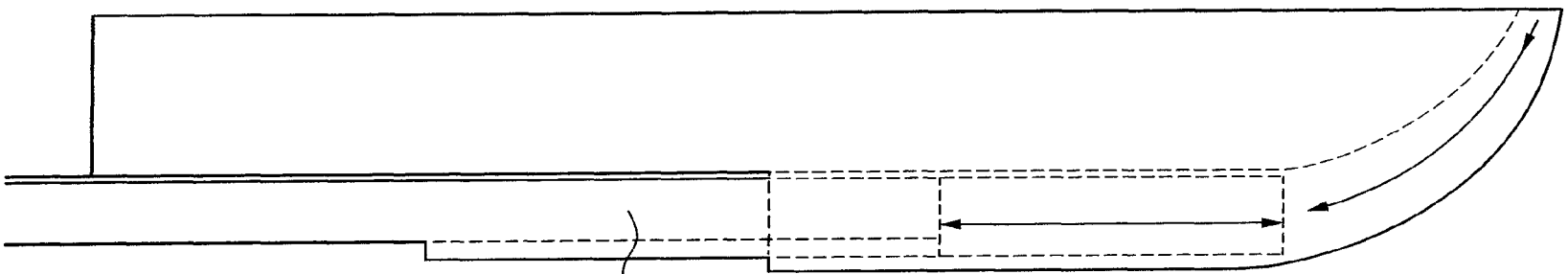
FIG. 6 is an elevational view of another movable member embodiment, in which the movable member can extend beyond the transom.

FIG. 5 shows a hull with a vented arrangement involving a step 26 in the hull with a movable member 27 that has three additional steps in the planing surface thereof. FIG. 6 shows a hull with a vented moving member 28 which can be extended beyond the stern of the boat for enhanced lift and stability.

Figure 7:
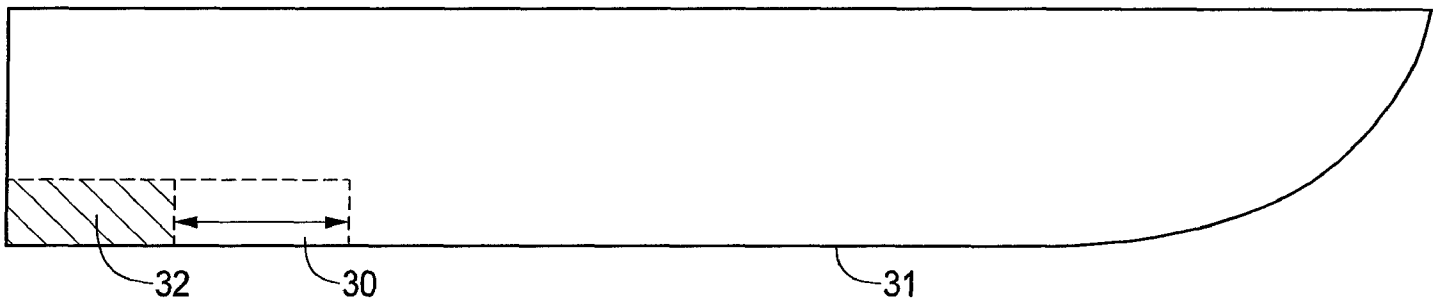
FIGS. 7 and 8 are simplified cross-sectional and stern elevational views for a non-vented boat channel arrangement.
Figure 8:
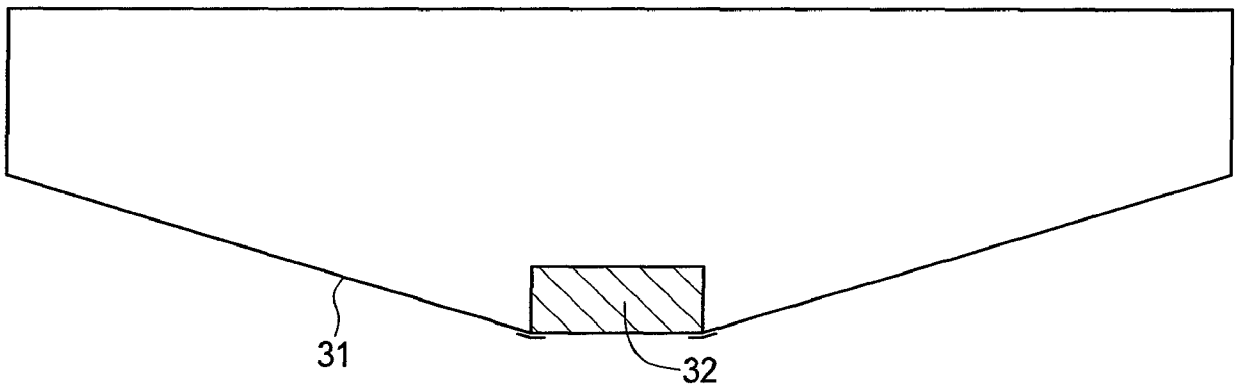

FIGS. 7 and 8 show a non-vented arrangement, in which channel 30 extends only part way along the hull 31, and specifically does not extend to an opening at the bow of the boat. The channel 30 is not open to the atmosphere, and hence there is no air flow through channel 30. A movable member 32 is positioned in the channel, providing an adjustable step surface for the hull. In some arrangements, there can be more than one movable member in the channel. This arrangement provides the ability to alter the performance and handling characteristics of the boat to accommodate different sea conditions.

Figure 9:
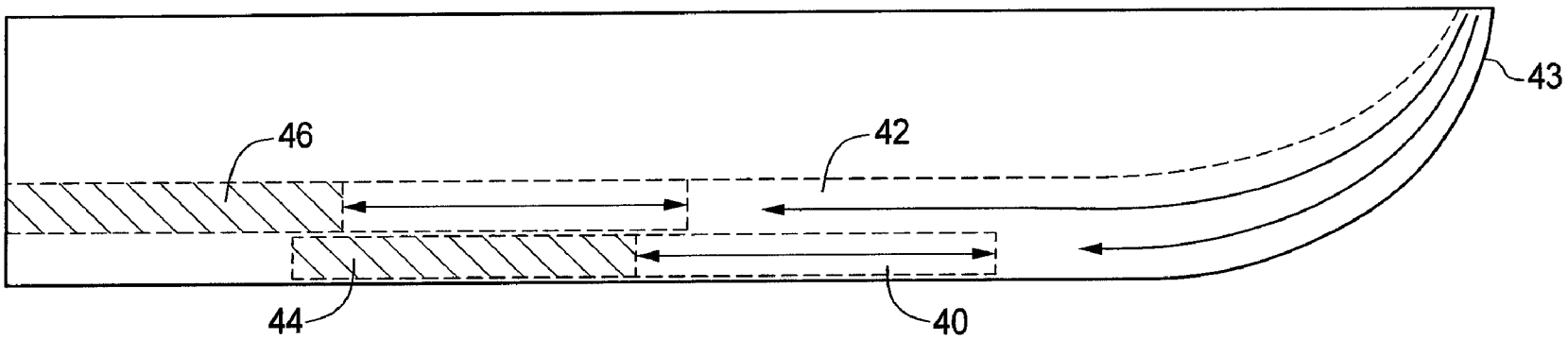
FIGS. 9 and 10 are cross-sectional views of a boat with more than one channel with a movable member therein.
Figure 10:
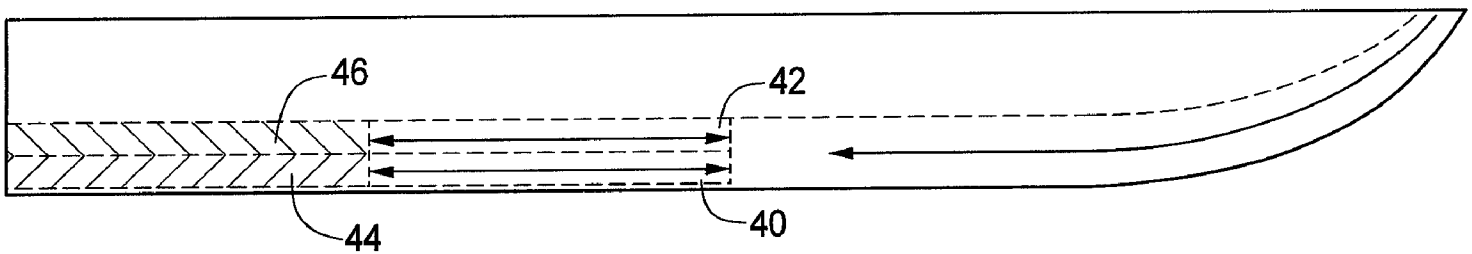

FIGS. 9 and 10 show a mono-hull configuration, which includes two channels 40 and 42 which extend rearwardly from the bow 43 of the boat, in the case of vented configurations as shown, or from a point to the rear of the bow in the unvented or side vented embodiments. Positioned in each channel 40 and 42 are movable members 44 and 46. Each member 44 and 46 is separately positionable, with the ability to be fixed in a desired position by various attachment means. FIG. 9 shows an arrangement where the two channels and the movable members therein extend to two different step end points along the hull, while in FIG. 10, the two channels end at the same point. The multi-step, multi-channel arrangements provide additional capability relative to different performance/handling characteristics.

The ventilated channel configurations disclosed above reduce water drag on the hull. A channel with a movable shoe therein creates an adjustable additional step in the bottom of the hull that reduces the hull surface area, to reduce water-generated friction drag and permits water to drain away from the hull in a controlled way, since the movable member/shoe inside the channel can be adjusted longitudinally. A movable member with a concave lower surface will generally trap air, which also reduces drag. A number of advantages can be realized with the above structure, including specifically, increased speed and efficiency because of reduction of drag on the hull. Further, the attitude of the bow can be changed by moving the shoe to different longitudinal positions inside the channel. Lifting the bow will lower the stern and vice versa. Water can be moved beyond the transom to provide more lift at the rear of the boat. The movable shoe arrangement permits a bow-up trim capability for conventional inboard configurations where the shaft from the motor extends at a fixed angle.

The trim of the boat can in effect be adjusted or the trim tabs adjusted by this arrangement to accommodate varying sea conditions, without having to adjust the trim of the engine, to produce a better ride. The boat will track, turn and ride better with the ventilated channel arrangement, due to the cushion of air it provides underneath the hull. Also, less power is needed for planing and running, and further, control over the center of the lift is provided, without having to adjust the engine trim angle or the trim tabs or changing the propeller. Hence, the above arrangement has significant advantages over existing stepped hull configurations.

FIGS. 11A-11H show various cross-sectional configurations of the movable member. It should be understood that these are some examples only; many other configurations are possible.

Figure 11A:
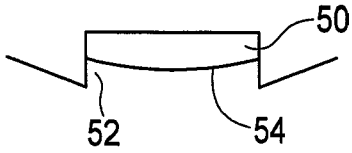
FIGS. 11A-11H show cross-sectional views of various movable member configurations.

FIG. 11A shows a movable member 50 in a channel 52. The movable member has a convex lower surface 54 which contacts the water when the movable member is in its extended position out from the channel.

Figure 11B:
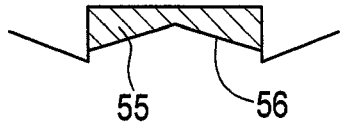

FIG. 11B shows a movable member 55 with an inverted wedge lower surface 56.

Figure 11C:
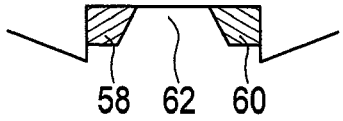

FIG. 11C shows a two-piece movable member comprising separate elements 58 and 60. Elements 58 and 60 are separated by a space 62. Typically elements 58 and 60 can move in tandem, but not necessarily. The elements could be co-planar or stacked.

Figure 11D:
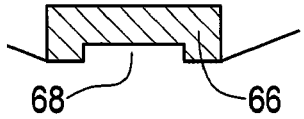

FIG. 11D shows a movable member 66 with an open tunnel-like configuration, the movable member having a small cutout portion 68 along its length.

Figure 11E:
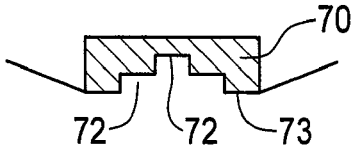

FIG. 11E shows a movable member 70 with a plurality of individual steps 72-72, defining lower surface 73. The number of steps and their relative dimensions can be varied.

Figure 11F:
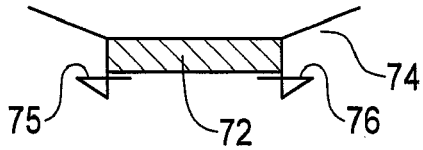

The movable member can be positioned entirely outside of the hull. This is shown in FIG. 11F, in which a movable member 72 is positioned entirely outside of the hull surface 74, supported by longitudinal braces 75, 76 along the lower edge of the movable member.

Figure 11G:
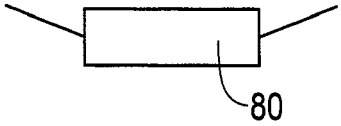

FIG. 11G includes an arrangement where a movable member 80 is positioned such that a portion thereof is within the outline of the hull, and a portion is outside of the outline of the hull, as the movable member extends outwardly from its channel. In the case of FIG. 11G, the movable member is located approximately one-half inside and one-half outside the outline of the hull, although this could be varied.

Figure 11H:
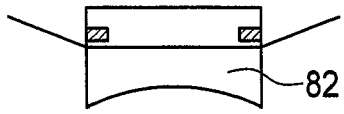

FIG. 11H shows an arrangement where the movable member 82 includes a portion outside of the hull, with a lower surface 84 that is concave.

FIGS. 11A-11H are intended to illustrate that a large variety of movable member cross-sectional configurations can be used to good effect.

Figure 12:
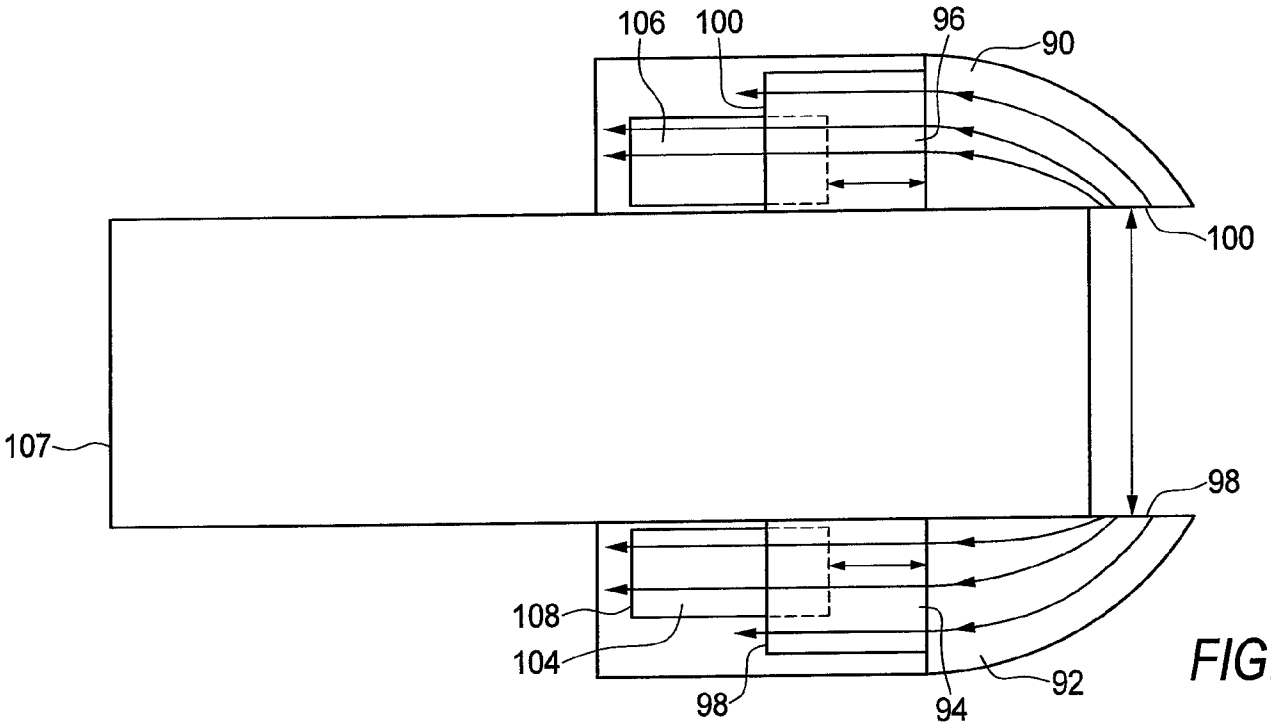
FIGS. 12-14 are various views of a hydroplane embodiment.
Figure 13:
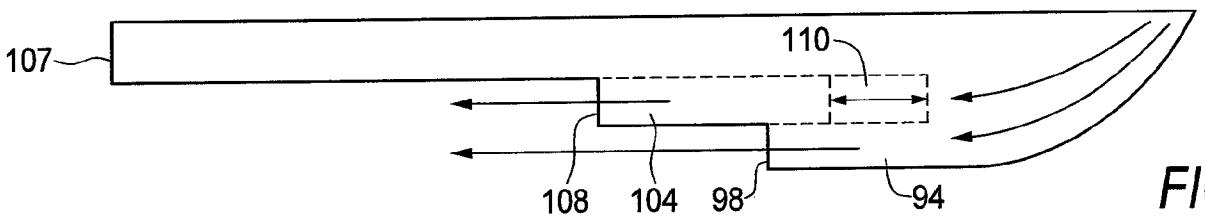
Figure 14:
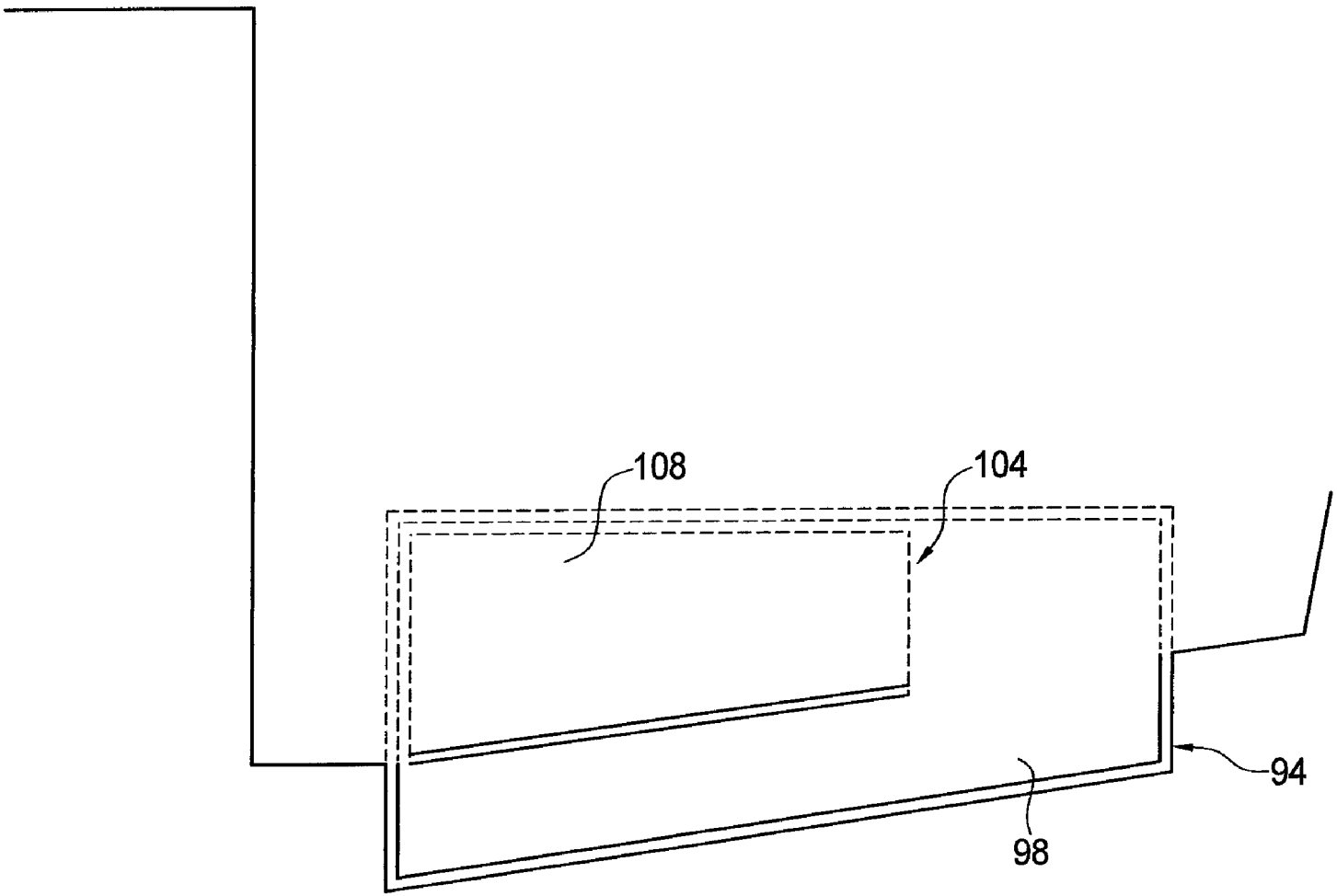

In addition to the mono-hull configuration, the channel/movable shoe arrangement described herein can be used with other hull configurations. FIGS. 12-14 show a hydroplane configuration having two hydroplane hull portions 90 and 92. In the hydroplane hull portions are channels 94 and 96 which permit air to flow from the front or from the sides away from the front of the hydroplane hull, entering through air vents 98 and 100, through the channels 94 and 96 to step surfaces 98 and 100 in each hull. Each channel 94 and 96 has a movable member 104, 106 positioned therein. For hull portion 90, as an example, the stern end 107 of movable member 104 forms a second step surface 108, with the position of the step surface being adjustable, depending upon the position of the movable member 104. Channels 94 and 96 are configured so that there is a substantial airflow therethrough. FIG. 14 shows the relationship between the movable member 104 and the channel 94 in which it is positioned. The adjustment range in the embodiment shown for movable member 104 is referred to at 110. The same basic structure shown in FIGS. 12-14 can also be used with a pontoon boat, having two spaced pontoons with a central connecting structure.

Figure 15:
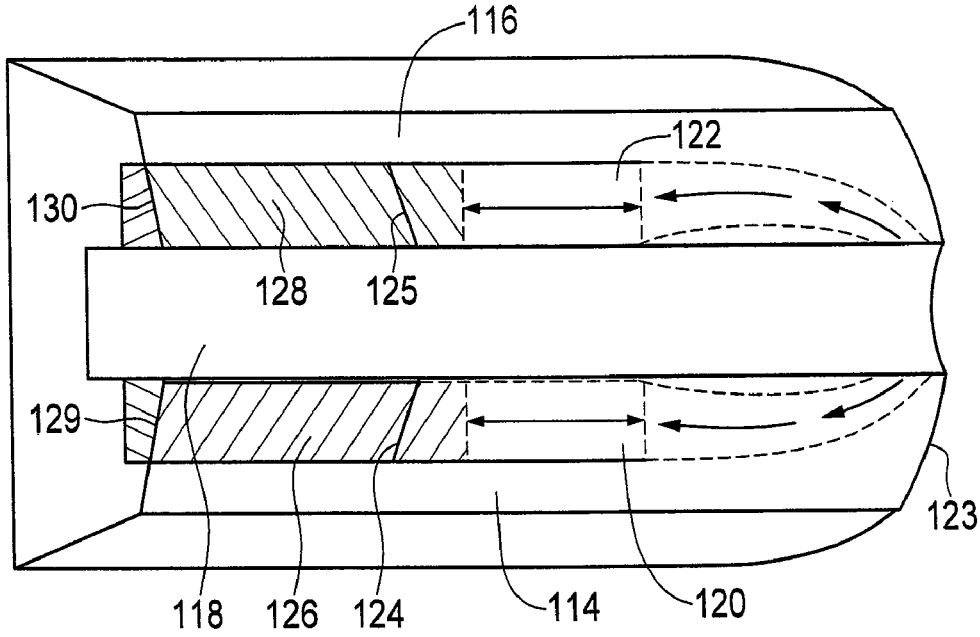
FIGS. 15 and 16 are two views of a tunnel hull configuration using the vented channel configuration.
Figure 16:
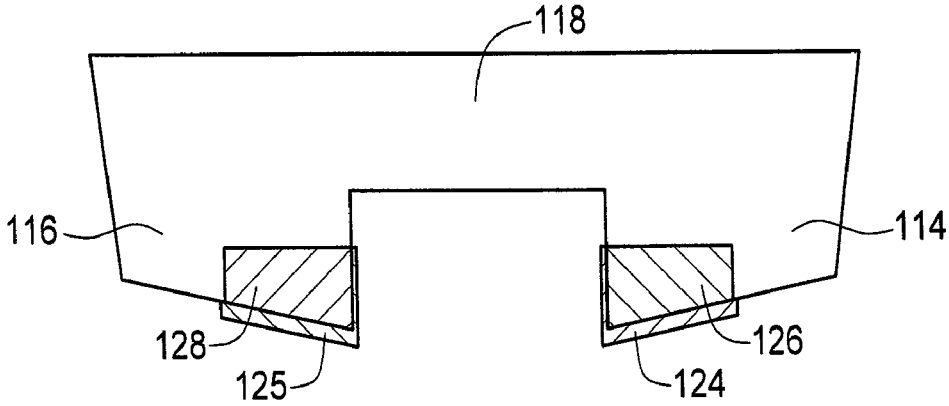

FIGS. 15 and 16 show the use of a movable member/channel arrangement in a tunnel hull boat. The tunnel hull boat includes two depending hull portions 114 and 116 joined by a center portion 118. The depending hull portions 114 and 116 have channels 120, 122 therein which extend from the bow 123 of the boat to step surfaces 124 and 125. Movable members/shoes 126, 128 are positioned in channels and move therein to define adjustable steps 129, 130. In the embodiment shown, the rear surfaces of the steps angle slightly outwardly. This, however, is not necessary. The movable member/shoe can be positioned in a desired location by various attachment means.

Figure 17:
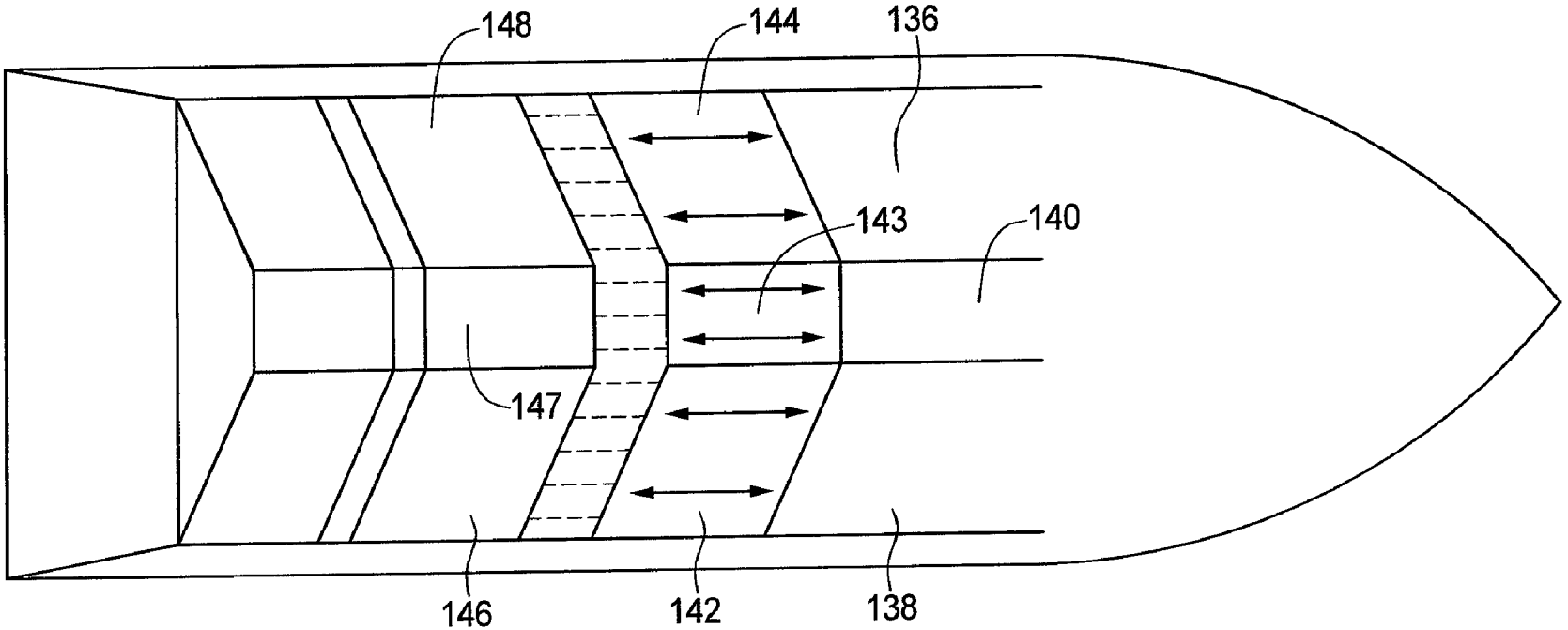
FIG. 17 is a bottom view showing a mono-hull with three separate planing surfaces using the vented channel configuration.

FIG. 17 is a mono-hull boat with three planar surfaces from side-to-side, specifically, side surfaces 136 and 138 and an intermediate center surface 140. Each surface includes a channel 142-144 therein, respectively, with movable members 146-148, respectively, positioned in the three channels. As with the other embodiments, the movable members can be positioned at various locations longitudinally, such that this stepped hull includes a fixed step surface and an adjustable step surface, depending upon the position of the movable member. The movable member is held in a desired positioned by any of various attachment means.

It should be understood that the various hull configurations described above and shown in the drawings are examples demonstrating that the principles of the present invention, namely, the use of a hull channel, or a support from the hull, vented or unvented, with a movable member therein to provide an adjustable step to improve handling and/or performance and fuel economy in various sea conditions, can be utilized in a wide variety of hull configurations.

Although a preferred embodiment of the invention has been disclosed for purposes of illustration, it should be understood that various changes, modifications and substitutions may be incorporated in the embodiment without departing from the spirit of the invention which is defined by the claims which follow.

What is claimed is:

1. A boat hull, comprising:

a boat hull having an exterior surface, with at least one step surface portion defined therein which changes the configuration of a lower surface of the hull;

a support system comprising a channel or flange support assembly which are fixed and extend substantially parallel longitudinally of the hull a selected distance from a start point which is located toward the bow of the boat; and a member positionable in the support system, wherein the member is movable along the support system wherein the channel or flange support system are open at an aft end thereof, wherein the member is supported to be movable along the support assembly approximately parallel to the hull of the boat and wherein a stern end of the member forms a step surface portion and can be fixed at selected locations along the hull, including beyond the aft end of the open support system or flange support assembly, thereby changing the position of a stern end of the movable member and hence the position of a step surface in the hull surface.

2. The boat hull of claim 1, wherein the flange members support the movable member below the hull surface.

3. The boat hull of claim 1, wherein the channel is closed except for the ends thereof, and extends all the way to the bow of the boat, with openings at the bow to the atmosphere, thereby venting the channel along the length thereof, permitting air to flow through the channel to the step surface.

4. The boat hull of claim 1, wherein the channel is closed except for the ends thereof, the channel opening to the sides of the boat and the atmosphere rearward of the bow, thereby venting the channel along the length thereof.

5. The boat hull of claim 1, wherein the boat hull has at least one fixed step surface therein at a selected position along the hull, wherein the channel extends from the fixed step surface.

6. The boat hull of claim 5, wherein the boat hull includes more than one fixed step and a channel associated with each fixed step, and further including a movable member positioned within each of said channels.

7. The boat hull of claim 1, wherein the movable member has a curved lower surface.

8. The boat hull of claim 7, wherein the lower surface is concave.

9. The boat hull of claim 1, wherein the movable member comprises two separate portions, movable together or independently within the channel.

10. The boat hull of claim 1, wherein the movable member has a lower surface defined by a series of steps.

11. The boat hull of claim 1, wherein the movable member has an angled lower surface.

12. The boat hull of claim 1, wherein the movable member is positioned outside of the boat hull, adjacent the hull surface.

13. The boat hull of claim 1, wherein a portion of the movable member is positioned within the hull and the remaining portion outside of the hull.

14. The boat hull of claim 1, wherein the boat hull is a hydroplane, having two spaced-apart hull portions, and wherein each hull portion has a fixed step surface, a channel extending from the fixed step surface to the bow of the hull portion or to a selected point to the rear of the bow, and a movable member positioned in the channel, arranged to be supported at selected locations longitudinally of the hull, thereby defining an adjustable step for the boat hull.

15. The boat hull of claim 1, wherein the boat hull has a tunnel configuration, with two spaced outer depending portions and an intermediate portion, and wherein each of the two depending portions includes a fixed step surface and a channel which extends from the step surface to a bow end of the hull portion or to a point to the rear of the bow end, permitting air to flow therethrough, and further includes a movable member positionable therein, having an adjustable position defining an adjustable additional step for the hull.

16. The boat hull of claim 1, wherein the boat hull includes two side hull portions and a center portion, thereby defining a tunnel-type hull, and wherein each of the side and center portions include a step surface therein and a channel which extends from the fixed step surface forwardly of the boat and a movable member positioned therein, a stern end of which defines an adjustable additional step for the hulls.

17. The boat hull of claim 1, wherein the channel extends across a portion of the hull.

18. The boat hull of claim 5, wherein the channel extends across the entire hull.

* * * * *

UNITED STATES PATENT AND TRADEMARK OFFICE

CERTIFICATE OF CORRECTION

PATENT NO. : 8,201,513 B2
APPLICATION NO. : 12/431066
DATED : June 19, 2012
INVENTOR(S) : Lloyd T. Hansen It is certified that error appears in the above-identified patent and that said Letters Patent is hereby corrected as shown below:

On the Title page

Correction of item (76) inventors to:

Lloyd T. Hansen, sole inventor

Signed and Sealed this
Twenty-first Day of July, 2015

Michelle K. Lee

Michelle K. Lee
*Director of the United States Patent and Trademark Office*